US012687096B2

(12) United States Patent
Lopez et al.

(10) Patent No.: US 12,687,096 B2
(45) Date of Patent: Jul. 21, 2026

(54) PROCESS FOR CRUDE OIL STABILIZATION BY SEPARATING GASES FROM OIL PRODUCTION STREAMS

(71) Applicant: OCCIDENTAL OIL AND GAS CORPORATION, Houston, TX (US)

(72) Inventors: Andres S. Lopez, Katy, TX (US); Byron Griffin, Houston, TX (US)

(73) Assignee: Occidental Oil and Gas Corporation, Houston, TX (US)

( * ) Notice: Subject to any disclaimer, the term of this patent is extended or adjusted under 35 U.S.C. 154(b) by 0 days.

(21) Appl. No.: 18/715,914

(22) PCT Filed: Dec. 1, 2022

(86) PCT No.: PCT/US2022/080731
§ 371 (c)(1),
(2) Date: Jun. 3, 2024

(87) PCT Pub. No.: WO2023/102466
PCT Pub. Date: Jun. 8, 2023

(65) Prior Publication Data

US 2025/0034978 A1 Jan. 30, 2025

Related U.S. Application Data

(60) Provisional application No. 63/285,209, filed on Dec. 2, 2021.

(51) Int. Cl.
*E21B 43/34* (2006.01)

(52) U.S. Cl.
CPC ..... *E21B 43/34* (2013.01); *E21B 43/35* (2020.05)

(58) Field of Classification Search
CPC ..... E21B 43/34; E21B 43/35
See application file for complete search history.

(56) References Cited

U.S. PATENT DOCUMENTS

| | | | | |
|---|---|---|---|---|
| 6,648,944 | B1 * | 11/2003 | Baker | B01D 53/225 96/9 |
| 9,803,459 | B1 | 10/2017 | Leal | |
| 2011/0048546 | A1 | 3/2011 | Bjorge et al. | |
| 2013/0298601 | A1 | 11/2013 | Prim et al. | |
| 2015/0354258 | A1 * | 12/2015 | Geysels | E05D 15/0686 49/506 |
| 2018/0187095 | A1 * | 7/2018 | Soliman | B03C 11/00 |
| 2019/0105600 | A1 * | 4/2019 | Chinn | B01D 53/226 |
| 2019/0368326 | A1 | 12/2019 | Drescher et al. | |
| 2020/0240255 | A1 | 7/2020 | Forthuber et al. | |
| 2020/0370407 | A1 | 11/2020 | Bittel et al. | |

FOREIGN PATENT DOCUMENTS

| | | | |
|---|---|---|---|
| WO | 86/03252 | A1 | 6/1986 |
| WO | 2009/131462 | A2 | 10/2009 |
| WO | 2019/071082 | A1 | 4/2019 |

OTHER PUBLICATIONS

International Search Report and Written Opinion for corresponding PCT/US2022/080731 dated Mar. 6, 2023 (11 pp).

* cited by examiner

*Primary Examiner* — Silvana C Runyan
(74) *Attorney, Agent, or Firm* — Renner, Kenner; Arthur M. Reginelli

(57) ABSTRACT

A process for stabilizing crude oil by separating a crude oil stream into a gaseous stream and a liquid-rich stream, and then employing at least a portion of the gaseous stream to assist in the further separating of gases entrained in the liquid-rich stream.

16 Claims, 1 Drawing Sheet

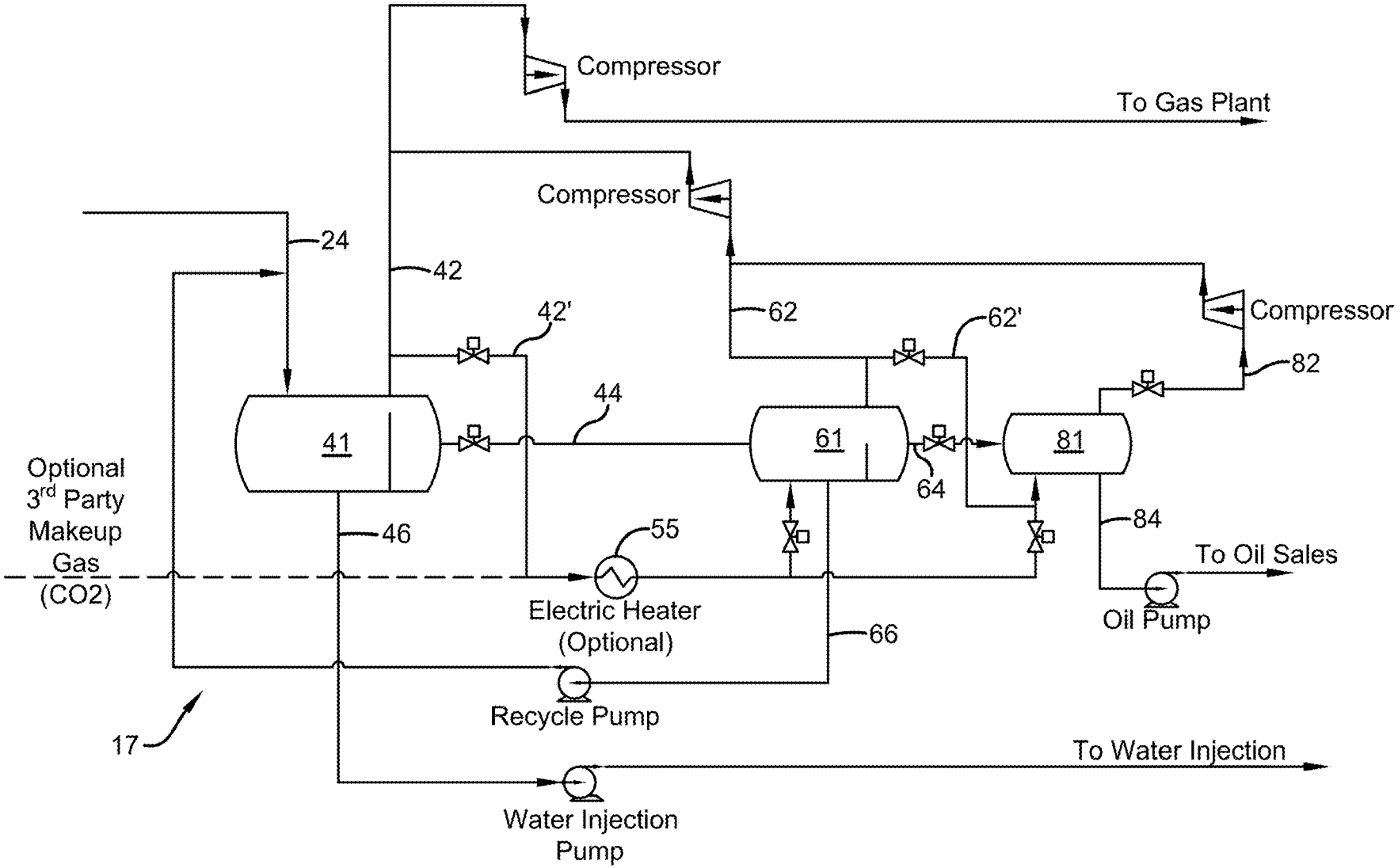
To Gas Plant
Compressor
Compressor
Compressor
82
To Oil Sales
Oil Pump
84
81
62'
64
61
62
66
To Water Injection
55
Electric Heater
(Optional)
Recycle Pump
Water Injection
Pump
44
42'
42
46
41
24
17
Optional
3rd Party
Makeup
Gas
(CO2)

PROCESS FOR CRUDE OIL STABILIZATION BY SEPARATING GASES FROM OIL PRODUCTION STREAMS

This application is a National-Stage Application of PCT/US2022/080731 filed on Dec. 1, 2022, which claims the benefit of U.S. Provisional Application No. 63/285,209 filed on Dec. 2, 2021, which are incorporated herein by reference.

FIELD OF THE INVENTION

Embodiments of the present invention are directed toward systems and methods for separating gases from oil production streams.

BACKGROUND OF THE INVENTION

Enhanced oil recovery (EOR) is a technique used to improve oil production from formations containing limited oil or oil that is not easily displaced from the formation. While many EOR techniques exist, carbon dioxide injection, which is also referred to as carbon dioxide flooding, is a common EOR technique that relies on miscibility of carbon dioxide and oil, which results in high oil displacement efficiency. During production, carbon dioxide is injected under high pressures into the formation, typically in conjunction with water, from an injection well, and a complementary production well then produces the oil production stream. Carbon dioxide is often alternated with water to flood the formation using a technique that is often referred to as "water alternating gas" or WAG flood.

The production stream resulting from EOR operations employing carbon dioxide typically contain rather large volume fraction of carbon dioxide and water, and smaller volume fractions of hydrocarbons displaced from the formation. The production stream is typically directed to a separation facility, which is often a satellite facility associated with the oil field, where one or more of the constituents of the production stream are separated. For example, it is common to separate the gases from the liquids at the satellite facility so that the gas stream, which includes a large volume of carbon dioxide, can be directed to a gas processing plant where hydrocarbon gases can be separated from the carbon dioxide. The carbon dioxide can then be recycled back for use in carbon dioxide flooding or sequestered by downhole injection. The liquid stream is then typically routed to a tank facility where the hydrocarbons are gravity separated from the water. The separated hydrocarbon liquids can then be delivered to market, and the water is recycled by using it for reservoir flooding or sequestration by underground injection.

SUMMARY OF THE INVENTION

One or more embodiments of the present invention provide a process for separating an oil field production stream, the process comprising the steps of (i) providing a production stream including oil, hydrocarbon gas, water, and carbon dioxide; (ii) separating at least a portion of the carbon dioxide and hydrocarbon gas from the production stream within a first separator to thereby produce a first liquid-rich stream and a first gaseous stream; (iii) directing the first liquid-rich stream to a second separator; (iv) directing at least a portion of the first gaseous stream to the second separator; and (v) diffusing the at least a portion of the first gaseous stream into the first liquid-rich stream within said second separator.

BRIEF DESCRIPTION OF THE DRAWING

The FIGURE is a schematic of a system according to embodiments of the invention.

DETAILED DESCRIPTION OF ILLUSTRATIVE EMBODIMENTS

Embodiments of the invention are based, at least in part, on the discovery of a process to stabilize crude oil (i.e. reduce the Reid Vapor Pressure (RVP) of crude oil) while maintaining the oil at elevated pressures. As a result, the other constituents of an oil production stream, such as those constituents that are typically reinjected into a formation such as carbon dioxide, can likewise remain at higher pressures, which advantageously reduces energy inputs that are needed to pressurize these streams for reinjection. In particular embodiments, the crude oil that is stabilized by the processes of this invention are obtained by enhanced oil recovery (EOR) oil production systems wherein the post-production oil separation occurs within a tankless processing system. According to embodiments of the invention, a portion of the carbon dioxide separated from the production stream is used in downstream separators to facilitate separation of the dissolved or entrained volatile gases (i.e. light hydrocarbons). In other words, a gaseous stream separated upstream in the process is used downstream as a stripping gas. In one or more embodiments, the system takes advantage of a staged reduction in the pressure of the oil-containing stream to allow use of the previously separated gaseous streams, which contain carbon dioxide, without requiring separation of light hydrocarbons from these gaseous streams.

Oil Production System

Those skilled in the art appreciate that the oil stabilization system of the present invention is one component of an overall oil production system that may include an oil field, a satellite separation facility, an optional downstream gas plant, and optional oil storage tanks. In one or more embodiments, the oil stabilization system of the present invention may be located within a central processing facility, which according to embodiments of the invention is a tankless central processing facility. As those skilled in the art appreciate, a tankless central processing facility is a facility that does not process the crude in settling or gravitational tanks.

The various constituents of the oil production system that work in conjunction with the oil stabilization system of this invention may be conventional in nature. In particular embodiments, the systems and processes of this invention operate in conjunction with oil fields or oil field systems that operate by enhanced oil recovery (EOR) techniques, particularly those that undergo carbon dioxide flooding. In one or more embodiments, the oil field undergoes a WAG flood with carbon dioxide as the injected gas. The skilled person appreciates that oil fields generally a plurality of wells that produce a crude production stream. The crude production stream generally includes a mixture of hydrocarbon gases and non-hydrocarbon gases, as well as water and liquid hydrocarbons.

The crude production stream is typically routed, via appropriate conduit, to a satellite facility downstream of the oil field, but typically associated with the oil field. These satellite facilities include one or more separators that advantageously separate the input oil field production stream (i.e. crude production stream) into a gaseous component (also referred to as gaseous stream) and a liquid component, which may be referred to as a liquid stream. The liquid stream is advantageously separated into an aqueous stream and a liquid hydrocarbon stream. In one or more embodiments, the satellite facility may include a two-phase separator that produces a gaseous stream that can be carried away from the satellite facility, via an appropriate conduit to, for example, a gas plant where the constituents of the gaseous stream can be separated as desired. For example, the gaseous stream can undergo separation to separate carbon dioxide from hydrocarbon gases. The two-phase separator also produces a liquid stream that is transported, via appropriate conduit, and treated, for example at a central processing facility, in order to, among other things, stabilize the liquid hydrocarbon product in accordance with aspects of this invention.

Input Stream to Central Processing Facility

As indicated above, aspects of this invention are directed toward a method and system for treating a liquid hydrocarbon stream within, for example, a central processing facility. This facility receives an input stream from, for example, a satellite facility associated with one or more oil fields. In other embodiments, the input stream into the central processing facility is received directly from an oil field. In either event, this input stream, which is generally a liquid stream, includes water, hydrocarbon liquids, and dissolved or otherwise entrained gases. The gases include hydrocarbon gases and non-hydrocarbon gases such as, but not limited to, carbon dioxide and other gases typically found within a EOR production stream. Unless otherwise specified, reference to gas or liquid refers to the state of any particular substance at standard conditions of temperature and pressure.

Depending on the conditions within the conduit delivering the input stream to the central processing facility, the skilled person also appreciates that a portion of the gases may be separated from the liquids upon entering or as initially processed within the central processing facility.

In one or more embodiments, the input stream that enters the central processing facility (i.e. enters the first separator within the central processing facility) at a temperature of from about 10 to about 30° C., or from about 12 to about 20° C., and a pressure of from about 100 to about 225 psig, or from about 125 to about 200 psig.

In one or more embodiments, the composition of the input stream may generally be characterized and quantified by the flowrate of the major constituents within the input stream. For example, the input stream can be characterized by including from about 0.4 to about 1.2 million standard cubic feet per day of gas (MMSCFD), from about 4500 to about 6500 barrels of oil per day (BOPD), and from about 40,000 to about 55,000 barrels of water per day (BWPF). The gas portion of the input stream may generally be quantified based upon the mole fraction of the major constituents of the gas portion. For example, the gas portion of in the input stream may include from about 80 to about 95 mole % carbon dioxide, from about 3 to about 10 mol % methane, from about 1 to about 4 mole % ethane, from about 1 to about 4 mole % propane, and from about 2 to about 8 mole 5 C4 or higher hydrocarbon gases, with residual non-hydrocarbon gases such as, but not limited to, nitrogen.

Oil Stabilization System

According to aspects of this invention, a liquid stream obtaining from an oil field operation, such as a stream obtained from a satellite separation facility (e.g. a facility operating a two-phase separator) is treated to obtain a desired crude oil product. One or more embodiments of the present invention can be described with reference to the FIGURE, which shows an oil stabilization system 17 including, in series, a first-stage separator 41, a second-stage separator 61, and a third-stage separator 81. System 17 receives a liquid stream via conduit 24 and then treats the liquid stream by undergoing a first-stage separation at first-stage separator 41, a second-stage separation at second-stage separator 61, and a third-stage separation at third-stage separator 81.

In one or more embodiments, first-stage separator 41, which may simply be referred to as separator 41, is adapted to separate gas and liquids from the stream carried by conduit 24. As shown, first-stage separator may include a three-phase separator adapted to separate the input stream carried by conduit 24 into a gaseous stream, which is carried away from separator 41 via conduit 42, a liquid hydrocarbon stream, which is carried away from separator 41 via conduit 44, and an aqueous stream, which is carried away from separator 41 via conduit 46.

In one or more embodiments, the aqueous stream carried by conduit 46 can be directed to an injection well (not shown). In one or more embodiments, the aqueous stream may undergo intermediary separations to remove hydrocarbon liquids dissolved or otherwise entrained in the aqueous stream. For example, the aqueous stream can be treated within a hydrocyclone unit to produce a liquid hydrocarbon stream and an aqueous stream. This aqueous stream can then be directed to, for example, an injection well, while the liquid hydrocarbon stream can be introduced to a hydrocarbon stream of the process and optionally undergo further separations in one or more of the separators.

The liquid hydrocarbon stream exiting first-stage separator 41 via conduit 44 can be directed to downstream separators. As shown in the FIGURE, the liquid hydrocarbon stream is directed to second-stage separator 61, which may simply be referred to as separator 61. As shown, second-stage separator 61 may include a three-phase separator adapted to separate the liquid hydrocarbon stream (carried by conduit 44) into a gaseous stream, which is routed from second-stage separator 61 via conduit 62, a liquid hydrocarbon stream, which is routed from second-stage separator 61 via conduit 64, and an aqueous stream, which is routed form second-stage separator 61 via conduit 66.

In one or more embodiments, the aqueous stream exiting separator 61 via conduit 66 can be directed to further treatment, such as hydrocyclone unit, or, as shown in the FIGURE, the aqueous stream can be redirected upstream and recycled back through first-stage separator 41. For example, the aqueous stream carried by conduit 66 can be merged with the input stream carried by conduit 24.

In one or more embodiments, the liquid hydrocarbon stream formed by second-stage separator 61 and carried by conduit 64 can be directed to third-stage separator 81, which may simply be referred to as separator 81. As shown in the FIGURE, third-stage separator 81 may include a two-phase separator adapted to separate the liquid hydrocarbon stream into a gaseous stream, which is carried away from separator 81 via conduit 82, and a liquid hydrocarbon stream, which carried away from separator 81 via conduit 84.

In accordance with the present invention, at least a portion of the gaseous stream separated from the input stream within first-stage separator 41 is used as a stripping gas to facilitate removal of gaseous constituents dissolved or otherwise entrained in the liquid hydrocarbon stream separated from separator 41. As shown in the FIGURE, a slipstream of the gaseous stream exiting separator 41 is carried by conduit 42' to second-stage separator 61 where the gaseous stream is introduced to second-stage separator 61 as a stripping gas. Additionally, and as also shown in the FIGURE, the gaseous stream carried by conduit 42' can be introduced to third-stage separator 81 as a stripping gas. In one or more embodiments, as shown in the FIGURE, the slipstream of the gaseous stream exiting separator 41 can be heated within heater 55 prior to introducing the gaseous slipstream to second-stage separator 61 or third-stage separator 81 as a stripping gas. In one or more embodiments, the gaseous stream within conduit 42' is or is heated to a temperature of from about 80 to about 150° C.

Gases separated from second-stage separator 61, which gases include the stripping gas and other gases removed from the hydrocarbon liquid phase, are carried away from second-stage separator 61 via conduit 62. Likewise, gases separated from third-stage separator 81, which include the stripping gas and other gases separated from the liquid hydrocarbon stream, are carried away from third-stage separator 81 via conduit 82.

As also shown in the FIGURE, the various gas streams (i.e. gas streams carried by conduits 42, 62, and 82) can optionally undergo pressurization and can be directed to a gas separation unit (not shown) where the various gas constituents can be further separated as desired. As noted above, this may include separating the hydrocarbon gases from the non-hydrocarbon gases such as carbon dioxide. Those skilled in the art appreciate that the transport of the gas streams can take place by various mechanisms including pressurization as well as the use of eductors or ejectors.

In one or more embodiments, gases separated from downstream separators (i.e. separators other than the first separator) can be routed to downstream separators (e.g. second separator to third separator) and used as a stripping gas in accordance with the present invention. For example, as shown in the FIGURE, a slip stream of gas separated from second separator 61 via conduit 62 can be routed, via conduit 62', to third separator 81 and used therein as a stripping gas.

Multi-Stage Separator Characteristics

In one or more embodiments, first-stage separator 41 is operated at a pressure of from about 75 to about 200 psig, in other embodiments from about 100 to about 185 psig, and in other embodiments from about 125 to about 175 psig.

In one or more embodiments, second-stage separator 61 is operated at a pressure of from about 30 to about 125 psig, in other embodiments from about 35 to about 100 psig, and in other embodiments from about 40 to about 75 psig.

In one or more embodiments, third-stage separator 81 is operated at a pressure of from about 1 to about 10 psig, in other embodiments from about 2 to about 8 psig, and in other embodiments from about 3 to about 5 psig.

In one or more embodiments, the streams processed by first-stage separator 41, second-stage separator 61, and third-stage separator 81 undergo a pressure drop between each separator. Stated differently, first-stage separator 41 is operated at a pressure that is greater than the pressure at which second-stage separator 61 is operated, and second-stage separator 61 is operated a pressure that is greater than the pressure at which third-stage separator 81 is operated. In one or more embodiments, the pressure drop between each separator is at least 20 psig, in other embodiment at least 25 psig, and in other embodiments at least 30 psig.

Alternate Stripping Gases

In one or more embodiments, the stripping gas (i.e. the gaseous slipstream within conduit 42') that is supplied to second-stage separator 61 and/or third-stage separator 81 may be supplemented by or substituted by one or more gases obtained from alternate sources. For example, these gases, which can be obtained from alternate sources, may include carbon dioxide, nitrogen, or methane.

In other embodiments, the stripping gas can be supplied from the satellite separator. As the skilled person will appreciate, the stripping gas can be supplied from any upstream separator operating at a higher pressure than the separator to which the stripping gas is introduced. The skilled person understands that embodiments of the invention take advantage of the fact that the partial pressure of carbon dioxide relative to the hydrocarbon gases is greater at higher pressures, which allows the gaseous stream to be used as a downstream stripping gas without the need for purification.

Characteristics of Marketable Oil

As suggested above, practice of the present invention facilitates removal of lighter hydrocarbons dissolved or otherwise entrained in the desired hydrocarbon liquid product. Significantly, practice of the present invention achieves this result while maintaining the hydrocarbon liquids under pressure throughout the treatment process. Stated another way, the result can be achieved while processing the hydrocarbon liquids through a tankless process, which a skilled person understands is a process that does not include large-volume settling tanks. Inasmuch as settling tanks are nor used, the liquid hydrocarbon streams can be maintained under positive gauge pressure during each of the separation steps.

Advantageously, the process of the present invention facilitates removal of lighter hydrocarbons dissolved or otherwise entrained within the oil product. As a result, practice of the present invention offers the ability to control the RVP of the oil product while maintaining the gaseous streams at relatively high pressures. In one or more embodiments, practice of present invention provides an oil product having a Reid Vapor Pressure (RVP), as measured by ASTM D-323-20a (as published in 2020, the version in effect as of the filing date), of from about 3 to about 9, in other embodiments from about 5 to about 9, and in other embodiments from about 6 to about 8 psia. In these or other embodiments, practice of the present invention provides an oil product having an RVP, as determined by ASTM D-323-20a (as published in 2020, the version in effect as of the filing date), of less than 10, in other embodiments less than 9, and in other embodiments less than 8 psia. In one or more embodiments, the foregoing desired RVP values are obtained while maintaining the separated gas streams (i.e. the gas streams separated from the liquid hydrocarbon streams, at pressures above atmospheric pressure.

Examples

Examples were simulated using ProMax modeling software.

Generally speaking, two simulation systems were designed to treat an input stream that was formulated to mimic an input stream into a central processing facility from an EOR carbon-flooded field following separation at a satellite facility. Table I summarizes the characteristics of the input stream.

TABLE I

| Produced Gas Stream | | |
|---|---|---|
| Gas Flowrate | 0.6 | MMSCFD |
| Gas Composition - Mole Fraction | | |
| CO2 | 85 | % |
| Methane | 7 | % |
| Ethane | 2 | % |
| Propane | 2 | % |
| C4+ | 4 | % |
| Produced Oil Stream | | |
| Oil Flowrate | 5600 | BOPD |
| API | 35 | |
| Produced Water Stream | | |
| Water Flowrate | 47000 | BWPD |
| Specific Gravity | 1 | |

The first simulation system, which acted as a control example, included a system where the input stream was depressurized and degassed within a settling tank. The second simulation system, which was used for Examples 1-7, included a system wherein the input stream was treated within a central processing facility that included three separators. The first separator was a three-way separator that operated at 150 psig and about 15.6° C., a second separator downstream of the first that operated at 50 psig and about 14.4° C., and third separator downstream of the second that operated at 3 psig and about 11.1° C. A slip stream of the gaseous stream was taken from the first separator (i.e. the three-way separator) and introduced to the third separator as a sparge gas at the rate specified in Table II. No heat duty was added to the system.

The modeling software yielded RVP results for each of the oil streams that resulted from the various simulations. The results are provided in Table II.

TABLE II

| | Wellhead Temp (F.) | Stripping Gas (MSCFD) | Oil Volume @ Sales (BOPD) | Pipeline RVP (PSIA) |
|---|---|---|---|---|
| CO2 Enhanced Oil Recovery - Central Tank Battery (CTB) | | | | |
| Control | 60 | 0 | 5,140 | 5.98 |
| CO2 Enhanced Oil Recovery - Tankless Central Processing Facility (CPF) | | | | |
| Example 1 | 60 | 0 | 5,255 | 9.17 |
| Example 2 | 60 | 50 | 5,249 | 8.95 |
| Example 3 | 60 | 100 | 5,244 | 8.77 |
| Example 4 | 60 | 150 | 5,239 | 8.61 |
| Example 5 | 60 | 200 | 5,233 | 8.45 |
| Example 6 | 60 | 250 | 5,230 | 8.36 |
| Example 7 | 60 | 300 | 5,226 | 8.25 |

The simulation establishes that practice of the present invention can be used to reduce the RVP of crude oil while maintaining the gaseous component of the input stream at elevated pressures. The simulation also establishes that the amount of stripping gas introduced to downstream separators is directly proportional to the reduction in RVP; that is, as more stripping gas is used, the RVP of the oil continues to be reduced.

Various modifications and alterations that do not depart from the scope and spirit of this invention will become apparent to those skilled in the art. This invention is not to be duly limited to the illustrative embodiments set forth herein.

What is claimed is:

1. A process for separating an oil field production stream, the process comprising:

(i) providing a production stream including oil, water, and entrained gases including hydrocarbon gas and carbon dioxide;

(ii) separating at least a portion of the carbon dioxide and hydrocarbon gas from the production stream within a first separator to thereby produce a first separated liquid stream and a first gaseous stream, where the first separated liquid stream includes less entrained gasses than the production stream;

(iii) directing the first separated liquid stream to a second separator;

(iv) directing at least a portion of the first gaseous stream to the second separator;

(v) sparging the at least a portion of the first gaseous stream into the first separated liquid stream within the second separator; and (vi) separating at least a portion of the entrained gases from the first separated liquid stream to thereby form a second separated liquid stream, where the second separated liquid stream has less entrained gases than the first separated liquid stream.

2. The process of claim 1, where the first separated liquid stream includes gases entrained therein, and where said separating at least a portion of the first gaseous stream into the first separated liquid stream produces a second gaseous stream including at least a portion of the first gaseous stream and hydrocarbon gases entrained in said first separated liquid stream.

3. The process of claim 1, where separating at least a portion of the carbon dioxide and hydrocarbon gas from the production stream within a first separator takes place at a first gauge pressure.

4. The process of claim 3, where diffusing the at least a portion of the first gaseous stream into the first separated liquid stream within the second separator takes place at a second gauge pressure; and where said first gauge pressure is greater than said second gauge pressure.

5. The process of claim 1, where the second separated liquid stream has a Reid Vapor Pressure, as measured by ASTM D-323-20a, of less than 10.

6. The process of claim 1, further comprising directing the second separated liquid stream to a third separator; and further comprising directing the at least a portion of the first gaseous stream to the third separator.

7. The process of claim 6, where the second separated liquid stream includes gases entrained therein; further comprising sparging at least a portion of the first gaseous stream into the second separated liquid stream within the third separator; and further comprising separating at least a portion of the first gaseous stream from the second separated liquid stream within the third separator to thereby form a third separated liquid stream.

8. The process of claim 7, where diffusing the at least a portion of the first gaseous stream into the second separated liquid stream within said third separator takes place at a third gauge pressure.

9. The process of claim 8, where sparging the at least a portion of the first gaseous stream into the first separated liquid stream within the second separator takes place at a second gauge pressure, and where the second gauge pressure is greater than the third gauge pressure.

10. The process of claim 9, further comprising sparging at least a portion of the second gaseous stream into the second separated liquid stream within the third separator.

11. The process of claim 10, where said first separator operates at a pressure of from about 75 psig to about 200 psig; where the second separator operates at a pressure of from about 30 psig to about 125 psig; and where the second separator operates at a pressure of from about 1 psig to about 10 psig.

12. The process of claim 9 is tankless.

13. The process of claim 9, where at least one of the first separated liquid stream, the second separated liquid stream, and the third separated liquid stream has a Reid Vapor Pressure, as measured by ASTM D-323-20a, of from about 3 to about 9.

14. A process for separating an oil field production stream, the process comprising:

(i) providing a production stream including oil, water, hydrocarbon gas, and carbon dioxide;

(ii) separating at least some of the carbon dioxide from the production stream within a first separator to thereby produce a first liquid stream and a first gaseous stream;

(iii) directing the first liquid stream to a second separator; and (iv) sparging a sparging stream into the first liquid stream within the second separator, where the sparging stream is a gaseous stream, and where the sparging stream includes the carbon dioxide or some of the carbon dioxide separated from said separating at least some of the carbon dioxide from the production stream within a first separator.

15. The process of claim 14, further comprising separating at least some of the hydrocarbon gas from the production stream within the first separator, and where the sparging stream includes the hydrocarbon gas or some of the hydrocarbon gas separated from said separating at least some of the hydrocarbon gas from the production stream within the first separator.

16. The process of claim 7, where the third separated liquid stream has a Reid Vapor Pressure, as measured by ASTM D-323-20a, of less than 8.

* * * * *